US006691796B1

(12) United States Patent
Wu

(10) Patent No.: US 6,691,796 B1
(45) Date of Patent: Feb. 17, 2004

(54) POWER TOOL HAVING AN OPERATING KNOB FOR CONTROLLING OPERATION IN ONE OF ROTARY DRIVE AND HAMMERING MODES

(75) Inventor: Chien-Chun Wu, Taichung Hsien (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 0 days.

(21) Appl. No.: 10/456,090

(22) Filed: Jun. 6, 2003

(30) Foreign Application Priority Data

Feb. 24, 2003 (TW) ..... 92202847 U

(51) Int. Cl.[7] ..... B25D 11/04
(52) U.S. Cl. ..... 173/48; 173/109
(58) Field of Search ..... 173/48, 47, 109, 173/104, 205, 216, 217

(56) References Cited

U.S. PATENT DOCUMENTS

| | | | |
|---|---|---|---|
| 865,486 | A | 9/1907 | Gannon |
| 2,238,583 | A | 4/1941 | Dodge |
| 2,764,272 | A | 9/1956 | Reynolds |
| 2,968,960 | A | 1/1961 | Fulop |
| 3,252,303 | A | 5/1966 | Weasler et al. |
| 3,430,708 | A | 3/1969 | Miller |
| 3,730,281 | A | 5/1973 | Wood |
| 3,736,992 | A | 6/1973 | Zander et al. |
| 3,799,275 | A | 3/1974 | Plattenhardt et al. |
| 3,809,168 | A | 5/1974 | Formm |
| 3,834,468 | A | 9/1974 | Hettich et al. |
| 3,955,628 | A | 5/1976 | Grözinger et al. |
| 4,098,351 | A | 7/1978 | Alessio |
| 4,215,594 | A | 8/1980 | Workman, Jr. et al. |
| 4,274,304 | A | 6/1981 | Curtiss |
| 4,366,871 | A | 1/1983 | Dieterle et al. |
| 4,489,792 | A | 12/1984 | Fahim et al. |
| 4,522,270 | A | 6/1985 | Kishi |
| 4,567,950 | A | 2/1986 | Fushiya et al. |

(List continued on next page.)

FOREIGN PATENT DOCUMENTS

| | | |
|---|---|---|
| DE | 405191 | 12/1965 |
| DE | 1478982 | 1/1970 |
| DE | 2438814 | 3/1976 |
| DE | 2715682 | 10/1978 |
| DE | 4004464 | 1/1991 |
| DE | 4038502 | 6/1992 |
| EP | 0399714 | 11/1990 |
| GB | 1346537 | 2/1974 |
| GB | 1366572 | 9/1974 |

*Primary Examiner*—Scott A. Smith
(74) *Attorney, Agent, or Firm*—Marshall, Gerstein & Borun LLP

(57) ABSTRACT

A power tool includes a housing, a fixed ratchet seat, a drive spindle, a rotatable ratchet, and an operating knob. The ratchet seat is disposed immovably in the housing. The drive spindle extends rotatably through the ratchet seat and is axially movable between front and rear limit positions. The rotatable ratchet is mounted on the drive spindle for co-rotation therewith, and disengages the fixed ratchet seat when the drive spindle is at the front limit position, and engages the fixed ratchet seat when the drive spindle is at the rear limit position. The operating knob is sleeved rotatably on the housing, and is rotatable to drive rotation of a switching ring in the housing. The switching ring is associated operably with a latching seat on the drive spindle to enable and disable movement of the drive spindle between the front and rear limit positions.

3 Claims, 7 Drawing Sheets

U.S. PATENT DOCUMENTS

| | | | | | |
|---|---|---|---|---|---|
| 4,585,077 | A | | 4/1986 | Bergler | |
| 4,823,885 | A | | 4/1989 | Okumura | |
| 4,895,212 | A | | 1/1990 | Wache | |
| 4,898,249 | A | | 2/1990 | Ohmori | |
| 4,986,369 | A | | 1/1991 | Fushiya et al. | |
| 5,005,682 | A | | 4/1991 | Young et al. | |
| 5,025,903 | A | | 6/1991 | Elligson | |
| 5,159,986 | A | | 11/1992 | Höser | |
| 5,343,961 | A | | 9/1994 | Ichikawa | |
| 5,449,043 | A | | 9/1995 | Bourner et al. | |
| 5,458,206 | A | | 10/1995 | Bourner et al. | |
| 5,704,433 | A | | 1/1998 | Bourner et al. | |
| 5,711,380 | A | * | 1/1998 | Chen | 173/109 |
| 5,842,527 | A | * | 12/1998 | Arakawa et al. | 173/104 |
| 6,142,242 | A | * | 11/2000 | Okumura et al. | 173/48 |
| 6,199,640 | B1 | * | 3/2001 | Hecht | 173/205 |
| 6,202,759 | B1 | | 3/2001 | Chen | |
| 6,230,819 | B1 | * | 5/2001 | Chen | 173/48 |
| RE37,905 | E | | 11/2002 | Bourner et al. | |
| 6,520,267 | B2 | * | 2/2003 | Fünfer et al. | 173/48 |

* cited by examiner

POWER TOOL HAVING AN OPERATING KNOB FOR CONTROLLING OPERATION IN ONE OF ROTARY DRIVE AND HAMMERING MODES

CROSS-REFERENCE TO RELATED APPLICATION

This application claims priority of Taiwanese application no. 92202847, filed on Feb. 24, 2003.

BACKGROUND OF THE INVENTION

1. Field of the Invention

The invention relates to a power tool, more particularly to a power tool having an operating knob for controlling operation in one of rotary drive and hammering modes.

2. Description of the Related Art

A conventional power tool according to U.S. Pat. No. 6,202,759 includes a fixing gear wheel, an output axle, a spring, a movable gear wheel, a switching member, a fixing ring, a housing, and a rotary collar.

The fixing gear wheel is disposed immovably in the housing and is formed with first ratchet teeth. The output axle extends rotatably through the fixing gear wheel and is axially movable between front and rear limit positions relative to the fixing gear wheel. The spring serves to bias the output axle to the front limit position. The movable gear wheel is mounted on the output axle for co-rotation therewith and is formed with second ratchet teeth that confront the first ratchet teeth of the fixing gear wheel. The second ratchet teeth disengage the first ratchet teeth when the output axle is at the front limit position, and engage the first ratchet teeth when the output axle is at the rear limit position. The switching member has the output axle extending rotatably therethrough, is coupled to and is movable together with the output axle between the front and rear limit positions, and has a periphery formed with peripheral latching projections. The fixing ring is disposed between the switching member and the movable gear wheel, and is formed with a through hole that permits extension of the output axle therethrough. The through hole is defined by a periphery that is formed with retaining notches corresponding to the peripheral latching projections on the switching member. The housing is disposed to surround the output axle so as to confine the fixing gear wheel and the movable gear wheel therein. The rotary collar is sleeved rotatably on the housing, and has an inner wall formed with grooves corresponding to the peripheral latching projections of the switching member. As such, when the rotary collar is rotated, the switching member rotates accordingly so as to align or misalign the peripheral latching projections of the switching member and the retaining notches of the fixing ring, thereby enabling or disabling movement of the output axle between the front and rear limit positions for operating the power tool in one of rotary and hammering modes.

It is desirable to provide a power tool of the aforesaid type that has an operating knob requiring minimum force to switch between the rotary drive and hammering modes, that can ensure smooth and stable operation of a drive spindle, and that has components which are relatively easy to assemble.

SUMMARY OF THE INVENTION

According to the present invention, a power tool comprises a motor assembly, a fixed ratchet seat, a drive spindle, a biasing member, a rotatable ratchet, a latching seat, a switching ring, a torsion spring, a generally cylindrical housing, and an operating knob. The motor assembly has an end cap. The fixed ratchet seat is disposed externally of the motor assembly, is disposed non-movably and adjacent to the end cap, and is formed with first ratchet teeth. The drive spindle extends rotatably through the fixed ratchet seat and further extends rotatably and slidably through the end cap. The drive spindle is coupled to and is driven rotatably by the motor assembly. The drive spindle is axially movable between front and rear limit positions relative to the end cap. The biasing member serves to bias the drive spindle to the front limit position. The rotatable ratchet is mounted on the drive spindle for co-rotation therewith, and is formed with second ratchet teeth. The second ratchet teeth disengage the first ratchet teeth when the drive spindle is at the front limit position. The second ratchet teeth engage the first ratchet teeth when the drive spindle is at the rear limit position. The latching seat has the drive spindle extending rotatably therethrough. The latching seat is coupled to and moves together with the drive spindle between the front and rear limit positions. The latching seat has one end adjacent to the rotatable ratchet and formed with at least a peripheral latching projection. The switching ring is disposed between the latching seat and the rotatable ratchet, and is formed with a through hole for extension of the drive spindle therethrough. The through hole is defined by a periphery that is formed with at least a retaining notch corresponding to the peripheral latching projection on the latching seat. The switching ring is rotatable relative to the drive spindle from a first angular position, where the peripheral latching projection is misaligned from the corresponding retaining notch and abuts against the periphery of the through hole in the switching ring such that movement of the drive spindle from the front limit position to the rear limit position is prevented, to a second angular position, where the peripheral latching projection is aligned with the corresponding retaining notch so that when the drive spindle is forced toward the end cap of the motor assembly for moving from the front limit position to the rear limit position against the biasing action of the biasing member, the latching projection moves into the corresponding retaining notch. The switching ring is formed with an operating arm extension parallel to and offset from the drive spindle. The torsion spring is connected between the latching seat and the switching ring for biasing the switching ring from the second angular position to the first angular position. The housing is mounted on the end cap of the motor assembly and is disposed to surround the drive spindle so as to confine the fixed ratchet seat, the rotatable ratchet, the latching seat and the switching ring therein. The housing permits the operating arm extension to extend outwardly therefrom. The operating knob is sleeved rotatably on the housing, and has an inner knob surface formed with a pushing unit. The operating knob is rotatable relative to the housing in a first direction to cause the pushing unit to engage the operating arm extension for moving the switching ring from the first angular position to the second angular position against biasing action of the torsion spring, and in an opposite second direction that enables the torsion spring to provide a restoring force for restoring the switching ring from the second angular position back to the first angular position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
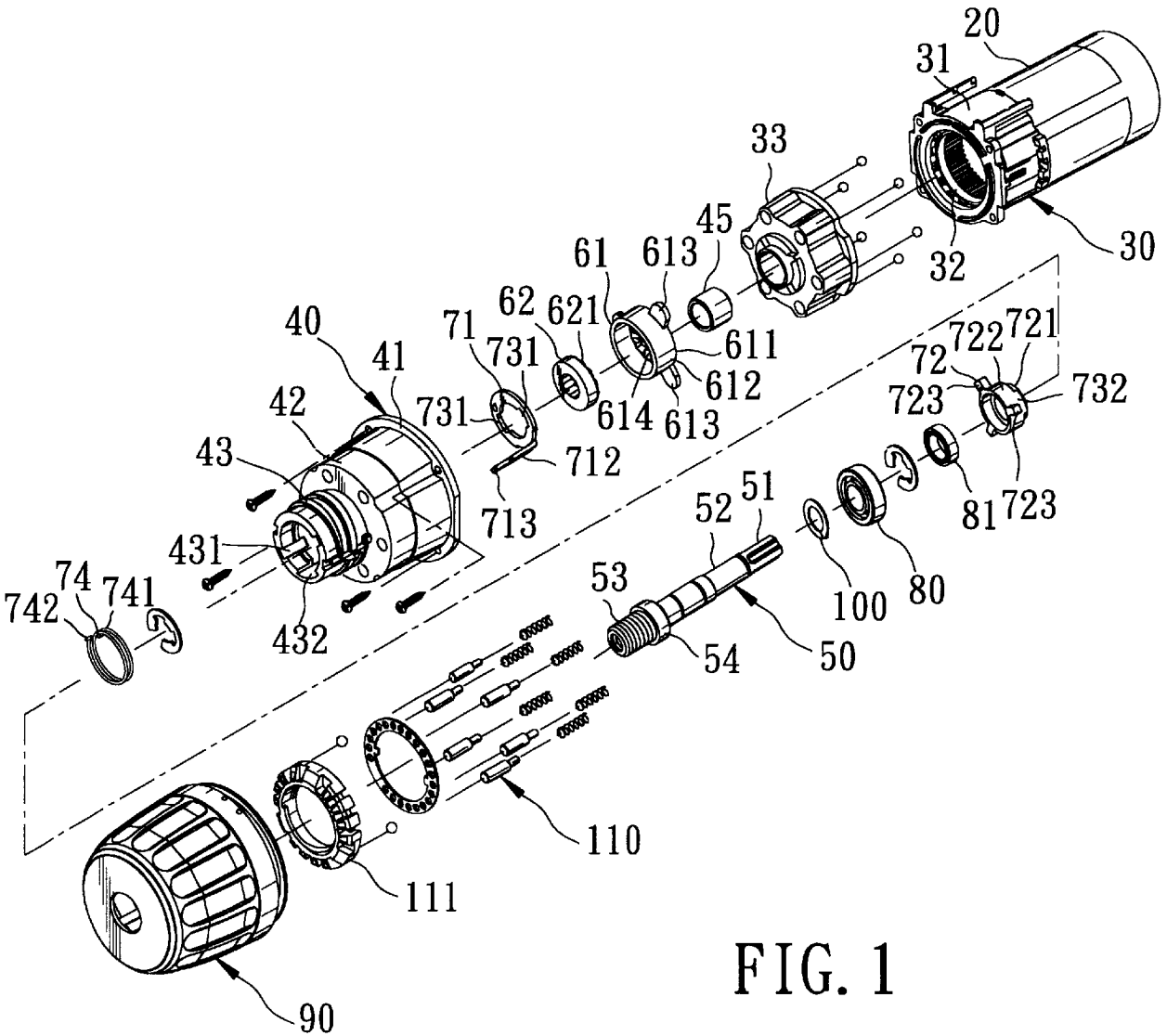
FIG. 1 is an exploded perspective view of the first preferred embodiment of a power tool according to the present invention.

Before the present invention is described in greater detail, it should be noted that like elements are denoted by the same reference numerals throughout the disclosure.

Referring to FIGS. 1 to 4, the first preferred embodiment of a power tool according to the present invention is shown to include a motor assembly 30, a fixed ratchet seat 61, a drive spindle 50, a biasing member 100, a rotatable ratchet 62, a latching seat 72, a switching ring 71, a torsion spring 74, a generally cylindrical housing 40, and an operating knob 90.

The motor assembly 30 is conventional in construction and includes a motor 20, a gear mechanism 31, and an end cap 33. The gear mechanism 31 is coupled to and is driven by the motor 20. The end cap 33 has a front side and a rear side. The rear side is disposed to abut against a casing of the gear mechanism 31. Since the structures of the motor 20 and the gear mechanism 31 are known to those skilled in the art, a detailed description of the same will be dispensed with herein for the sake of brevity.

The fixed ratchet seat 61 has an end wall 611, a front surface of which is formed with first ratchet teeth 614. A rear surface of the end wall 611 is disposed to abut against the front side of the end cap 33. A surrounding wall 612 extends axially from a periphery of the end wall 611 of the fixed ratchet seat 61 and surrounds the front surface of the end wall 611. The end and surrounding walls 611, 612 of the fixed ratchet seat 61 cooperatively confine a first receiving space. Preferably, the fixed ratchet seat 61 further includes lugs 613 that extend radially from the surrounding wall 612, the purpose of which will be described in the succeeding paragraphs.

The drive spindle 50 has a motor coupling end 51, a bit coupling end 53 opposite to the motor coupling end 51, and a sleeve portion 52 disposed between the motor coupling and bit coupling ends 51, 53. The sleeve portion 52 of the drive spindle 50 extends rotatably through the fixed ratchet seat 61. The motor coupling end 51 of the drive spindle 50 extends rotatably and slidably through the end cap 33, and is coupled to and is driven rotatably by the gear mechanism 31 of the motor assembly 30 in a conventional manner. The bit coupling end 53 is used to engage a tool bit (not shown) in a known manner. In this embodiment, the drive spindle 50 is axially movable between front and rear limit positions relative to the end cap 33.

Figure 4:
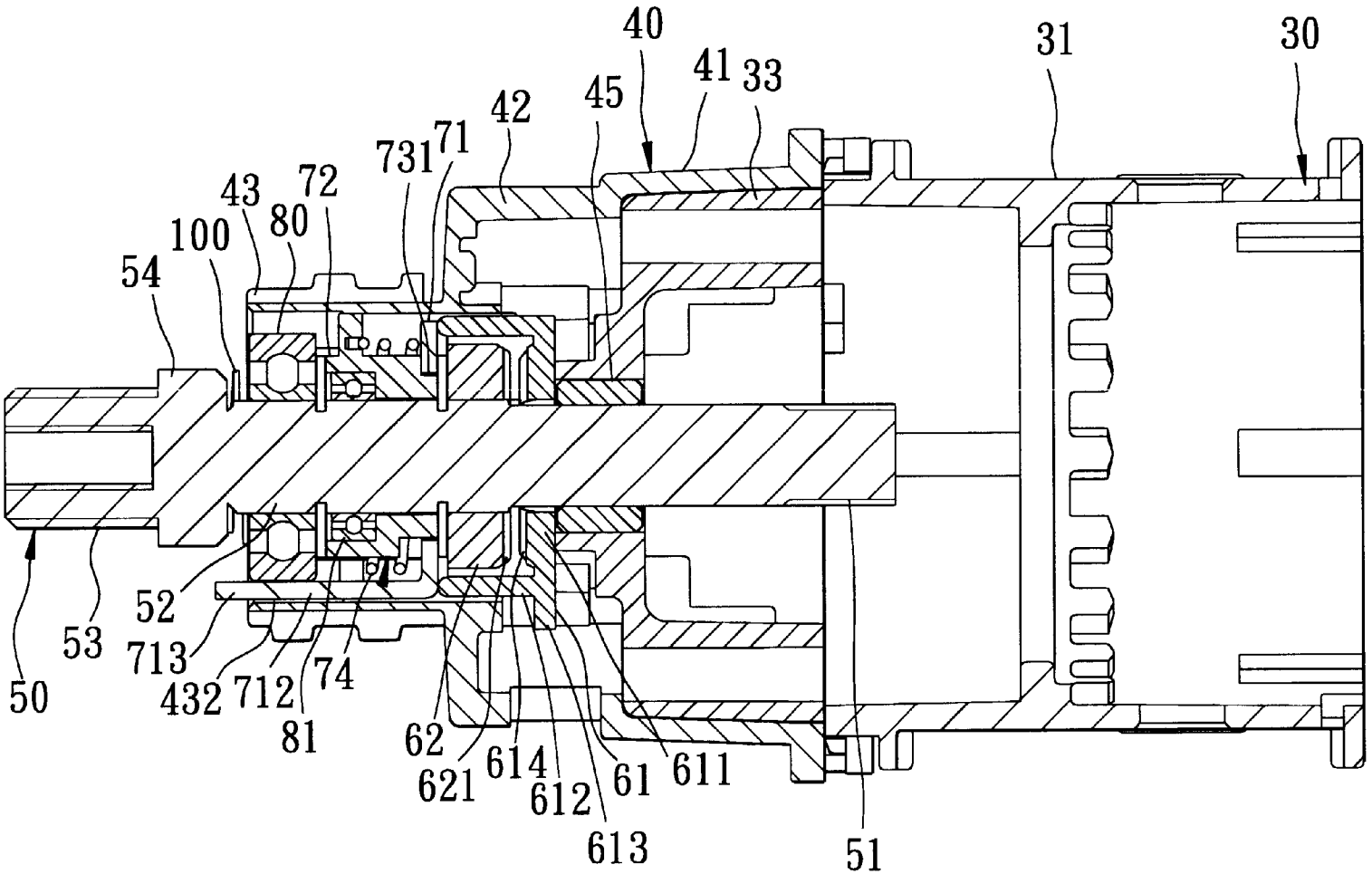
FIG. 4 is a sectional view of the first preferred embodiment in an assembled state, illustrating a drive spindle at a front limit position, and a rotatable ratchet when disengaged from a fixed ratchet seat.

The biasing member 100 serves to bias the drive spindle 50 to the front limit position, as best shown in FIG. 4.

Figure 7:
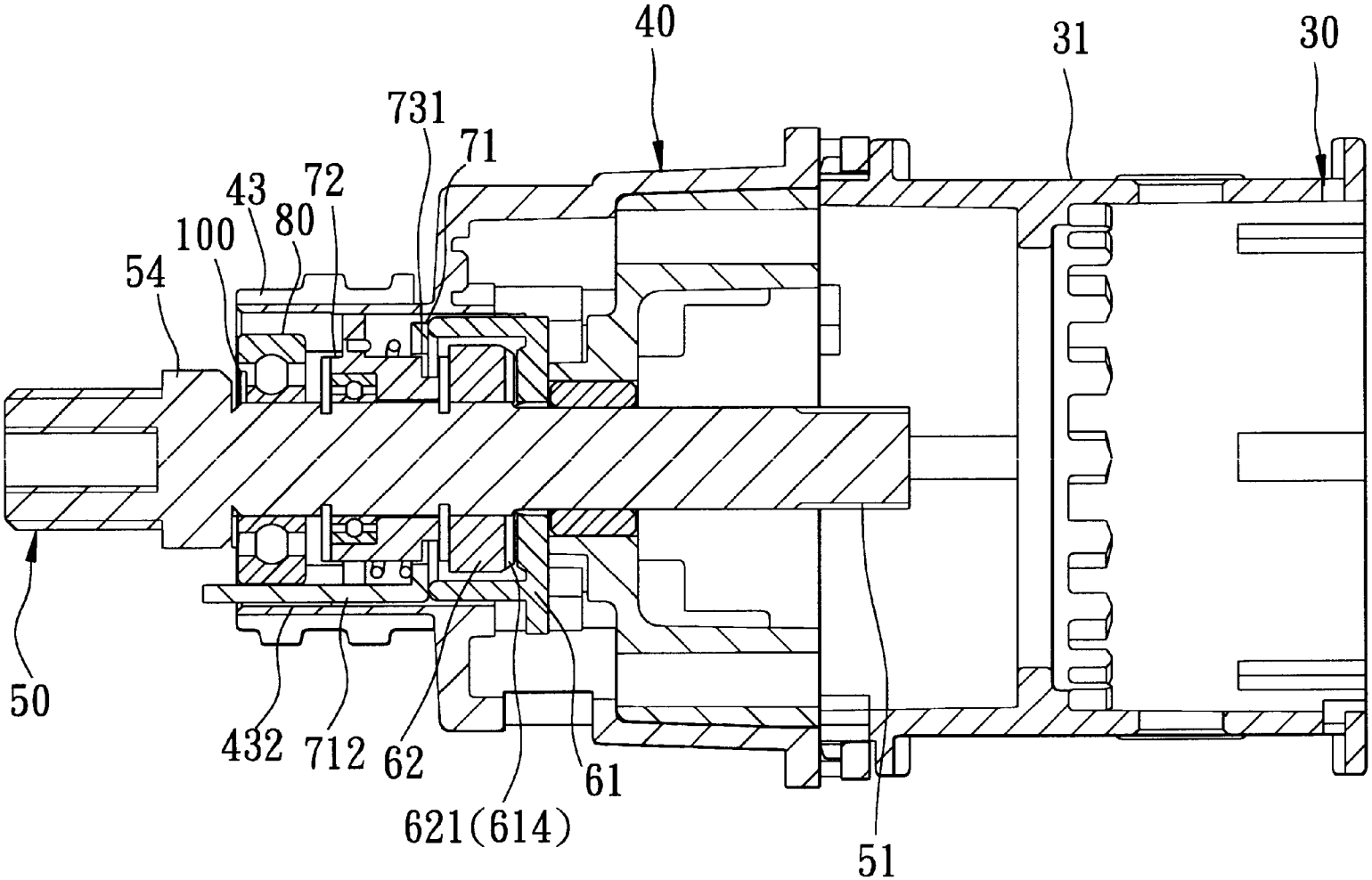
FIG. 7 is a sectional view of the first preferred embodiment in the assembled state, illustrating the drive spindle at a rear limit position, and the rotatable ratchet when engaging the fixed ratchet seat.

The rotatable ratchet 62 is mounted on the sleeve portion 52 of the drive spindle 50 for co-rotation therewith, is disposed in the first receiving space of the fixed ratchet seat 61, and has front and rear surfaces. The rear surface of the rotatable ratchet 62 is formed with second ratchet teeth 621 that confront the first ratchet teeth 614 of the fixed ratchet seat 61. The second ratchet teeth 621 disengage the first ratchet teeth 614 when the drive spindle 50 is at the front limit position, as shown in FIG. 4, and engage the first ratchet teeth 614 when the drive spindle 50 is at the rear limit position, as shown in FIG. 7.

Figure 2:
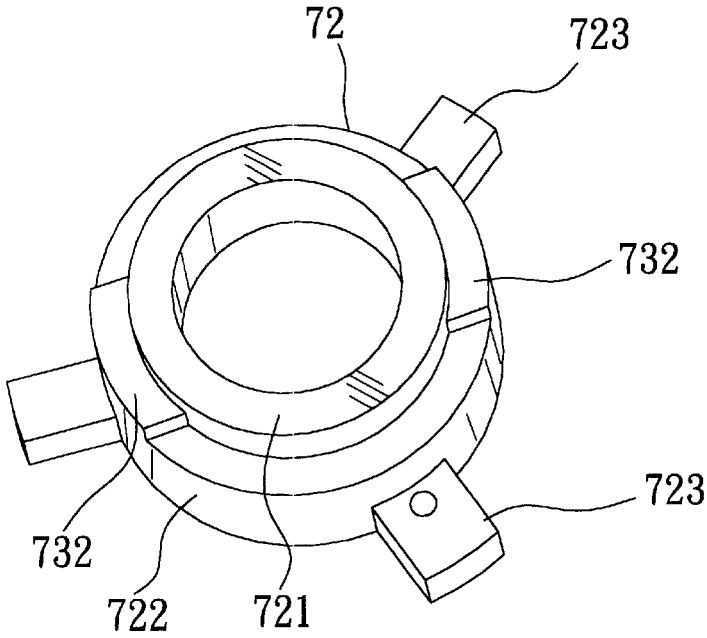
FIG. 2 is a perspective view of a latching seat of the first preferred embodiment.

The latching seat 72 has an end wall 721 through which the sleeve portion 52 of the drive spindle 50 extends rotatably. The latching seat 72 is coupled to and moves together with the sleeve portion 52 of the drive spindle 50 between the front and rear limit,positions. The end wall 721 has front and rear surfaces. The rear surface of the end wall 721 is disposed adjacent to the front surface of the rotatable ratchet 62. A surrounding wall 722 extends axially from a periphery of the end wall 721 of the latching seat 72, and surrounds the front surface of the end wall 721 of the latching seat 72. The end and surrounding walls 721, 722 of the latching seat 72 cooperatively confine a second receiving space. As best shown in FIG. 2, the periphery of the end wall 721 of the latching seat 72 is formed with a pair of peripheral latching projections 732, and the outer wall surface of the surrounding wall 722 of the latching seat 72 is formed with a set of radial lugs 723.

The switching ring 71 is disposed between the latching seat 72 and the rotatable ratchet 62, abuts against a distal front edge of the surrounding wall 612 of the fixed ratchet seat 61, and is formed with a through hole that permits extension of the sleeve portion 52 of the drive spindle 50 therethrough. The switching ring 71 is further formed with an operating arm extension 712 that is parallel to and offset from the drive spindle 50. The through hole in the switching ring 71 is defined by a periphery that is formed with retaining notches 731 corresponding to the peripheral latching projections 732 of the latching seat 72.

The torsion spring 74 is disposed between the latching seat 72 and the switching ring 71. Preferably, the torsion spring 74 has opposite ends 742, 741 connected respectively to one of the lugs 723 of the latching seat 72 and the switching ring 71.

The housing 40 includes a coupling portion 41, a threaded portion 43 opposite to the coupling portion 41, and a confining portion 42 disposed between the coupling and threaded portions 41, 43. In this embodiment, the housing 40 is disposed to surround the sleeve portion 52 of the drive spindle 50 so as to confine the end cap 33 in the coupling portion 41, the fixed ratchet seat 61 and the rotatable ratchet 62 in the confining portion 42, and the latching seat 72, the switching ring 71 and the torsion spring 74 in the threaded portion 43. The coupling portion 41 has a periphery that is formed with a set of fastener holes. The casing of the gear mechanism 31 has a periphery that is formed with a set of threaded holes corresponding to the faster holes in the coupling portion 41. The coupling portion 41 of the housing 40 is mounted on the gear mechanism 31 of the motor assembly 30 by inserting respectively screw fasteners through the fastener holes in the coupling portion 41 of the housing 40 and into the threaded holes in the casing of the gear mechanism 31 of the motor assembly 30. The confining portion 41 of the housing 40 has an inner surface formed with axially extending grooves (not visible in FIG. 1) that engage the lugs 613 on the fixed ratchet seat 61. Accordingly, the fixed ratchet seat 61, which is disposed externally of the motor assembly 30, is retained non-movably adjacent to the end cap 33. The threaded portion 43 of the housing 40 has an inner surface formed with axially extending grooves 431 and an outer surface formed with threads. The grooves 431 in the inner surface of the threaded portion 43 of the housing 20 receive the peripheral latching projections 723 of the latching seat 72, and permit axial movement and prevent rotation of the latching seat 72 in the housing 40. The inner surface of the threaded portion 43 of the housing 40 is further formed with an axially extending recess 432 that receives the operating arm extension 712 of the switching member 71, and that permits rotation of the switching ring 71 in the housing 40. In this embodiment, the threaded portion 43 of the housing 40 permits an engaging end 713 of the operating arm extension 712 of the switching member 71 to extend axially therethrough.

The bit coupling end 53 of the drive spindle 50 extends out of the threaded portion 43 of the housing 40, and is formed with an annular flange 54.

Figure 3:
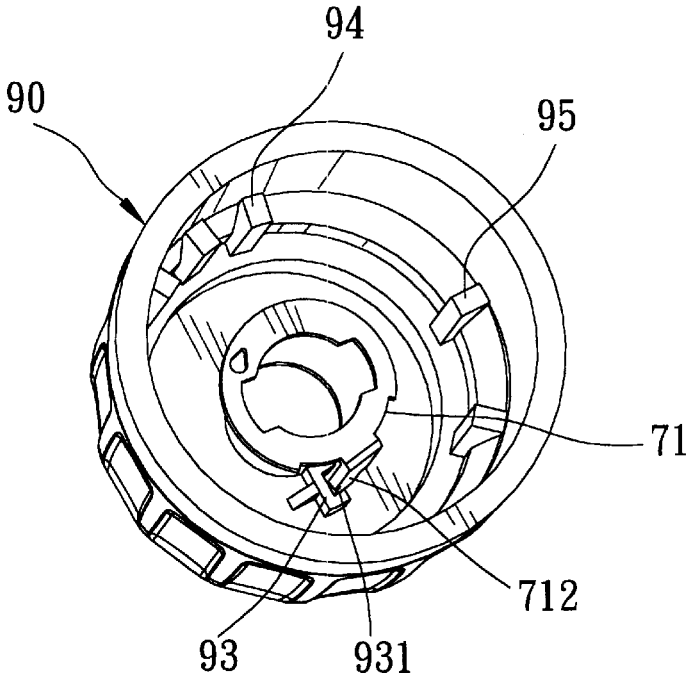
FIG. 3 is a perspective view of an operating knob and a switching ring of the first preferred embodiment.

The operating knob 90 has a front portion mounted on the threaded portion 43 of the housing 40, and a rear portion sleeved rotatably on the confining portion 42 of the housing 40. The front portion of the operating knob 90 has an inner knob surface formed with a first pushing unit 93, as best shown in FIG. 3. Preferably, the first pushing unit 93 is generally U-shaped and confines a space 931.

The power tool further comprises a bushing 45, and first and second bearing members 80, 81. The bushing 45 serves to mount rotatably and slidably the sleeve portion 52 of the drive spindle 50 on the end cap 33. The first bearing member 80 has an outer race that is secured to the inner surface of the threaded portion 43 of the housing 40, and an inner race that is in sliding engagement with the sleeve portion 52 of the drive spindle 50. The second bearing member 81 mounts rotatably the latching seat 72 on the sleeve portion 52 of the drive spindle 50, is received in the second receiving space of the latching seat 72, and has inner and outer races. Preferably, the outer and inner races of the second bearing member 81 are secured to the inner wall surface of the surrounding wall 722 of the latching seat 72 and the sleeve portion 52 of the drive spindle 50, respectively.

The biasing member 100 has opposite ends abutting respectively against the first bearing member 80 and the annular flange 54 on the bit coupling end 53 of the drive spindle 50.

Moreover, the gear mechanism 31 includes a torque control ring 32 that permits the gear mechanism 31 to transmit torque when the torque control ring 32 is held stationary relative to the housing 40, and that disables torque transmission by the gear mechanism 31 when permitted to rotate relative to the housing 40. The power tool further comprises a torque adjusting unit that includes a set of spring-loaded actuators 110 and a torque adjusting ring 111. Each of the spring-loaded actuators 110 of the torque adjusting unit is disposed in the end cap 33 of the motor assembly 30, and has a first end that extends through the confining portion 42 of the housing 40 and a second end that engages the torque control ring 32 of the gear mechanism 31. The torque adjusting ring 111 is mounted threadedly on the threaded portion 43 of the housing 40, abuts against the first end of the spring-loaded actuators 110, and has an outer peripheral surface formed with locking grooves (not visible). The inner surface of the operating knob 90 is further formed with projections 94 that are received in the locking grooves in the outer peripheral surface of the torque adjusting ring 111, as best shown in FIG. 3. The construction as such permits rotation of the operating knob 90, which directly rotates the torque adjusting ring 111, to result in axial displacement of the spring-loaded actuators 110 to vary force of the spring-loaded actuators 110 acting on the torque control ring 32, thereby controlling the torque transmission by the gear mechanism 31.

Figure 5:
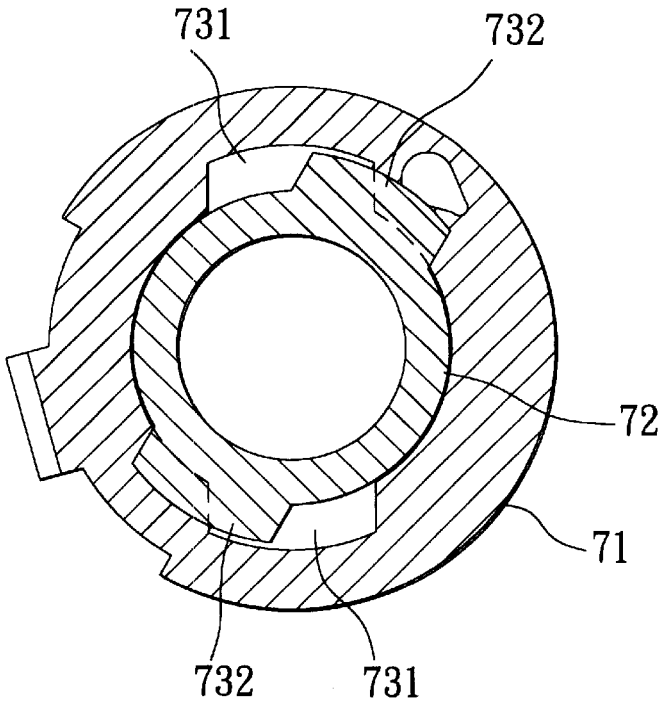
FIG. 5 is a sectional view to illustrate peripheral latching projections of the latching seat when misaligned from retaining notches and abutting against a periphery of the switching ring.
Figure 6:
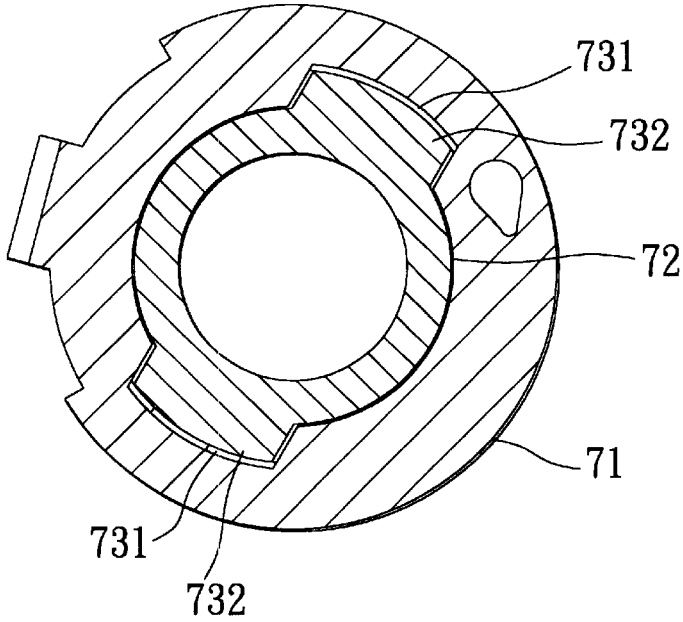
FIG. 6 is a sectional view to illustrate the peripheral latching projections of the latching seat when aligned with the retaining notches of the switching ring.

With further reference to FIGS. 5 and 6, when the switching ring 71 is in a first angular position relative to the drive spindle 50, the peripheral latching projections 732 of the latching seat 72 are misaligned from the retaining notches 731 in the switching ring 71 and abut against the periphery of the through hole in the switching ring 71, as best shown in FIG. 5. At this time, the latching seat 72 cannot move into the: through hole in the switching ring 71. As such, when the tool bit (not shown) on the bit coupling end 53 of the drive spindle 50 is pressed against a workpiece (not shown), movement of the drive spindle 50 from the front limit position to the rear limit position is prevented, and the second ratchet teeth 621 of the rotatable ratchet 62 do not engage the first ratchet teeth 614 of the fixed ratchet seat 61 such that the drive spindle 50 rotates without reciprocation in the axial direction. The power tool operates in a rotary driving mode at this time.

With further reference to FIG. 7, when the operating knob 90 is rotated in a first direction relative to the drive spindle 50, this causes the first pushing unit 93 to engage the operating arm extension 712 such that the engaging end 713 of the operating arm extension 712 is received in the space 931 in the first pushing unit 93, as best shown in FIG. 3. This further results in movement of the switching ring 71 from the first angular position to a second angular position against biasing action of the torsion spring 74. At the second angular position, the peripheral latching projections 732 of the latching seat 72 are aligned with the retaining notches 731 in the switching ring 71, as best shown in FIG. 6. At this time, the latching seat 72 can move into the switching ring 71. Therefore, when the tool bit (not shown) on the bit coupling end 53 of the drive spindle 50 is pressed against the workpiece (not shown), the drive spindle 50 is forced toward the end cap 33 of the motor assembly 30 to move from the front limit position to the rear limit position against the biasing action of the biasing member 100. This enables the second ratchet teeth 621 of the rotatable ratchet 62 to engage the first ratchet teeth 614 of the fixed ratchet seat 61. Accordingly, the drive spindle 50 oscillates in axial movement which results in hammering action of the drive spindle 50. It is noted that the biasing member 100 and the torsion spring 74 provide a buffering effect during the hammering action of the drive spindle 50.

Further, when the operating knob 90 is rotated in an opposite second direction relative to the drive spindle 50, at an angle of approximately 15 degrees in this embodiment, this causes the first pushing unit 93 to disengage the engaging end 713 of the operating arm extension 712 and enables the torsion spring 74 to provide a restoring force for restoring the switching ring 71 from the second angular position back to the first angular position.

Figure 8:
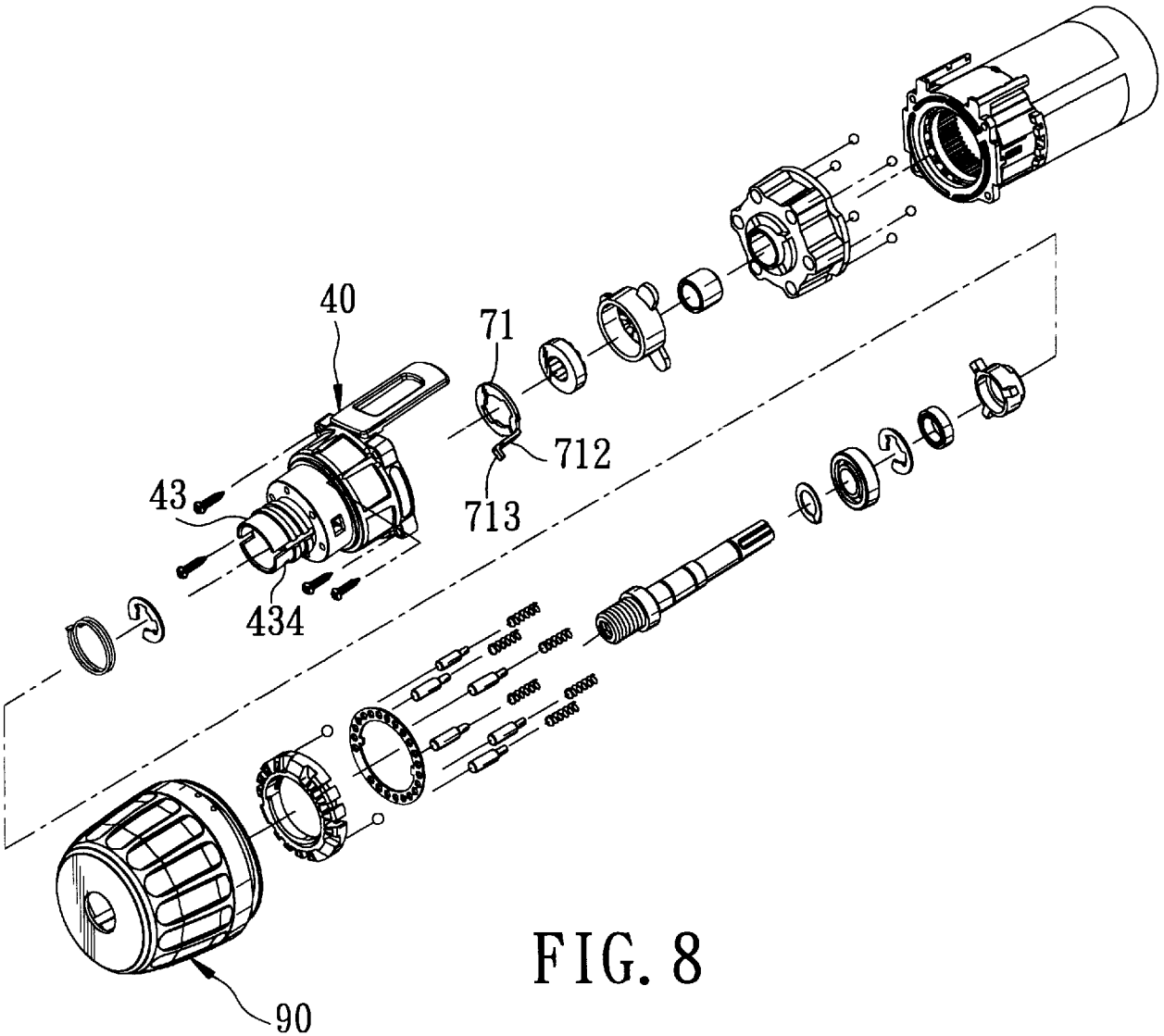
FIG. 8 is an exploded perspective view of the second preferred embodiment of a power tool according to the present invention.
Figure 9:
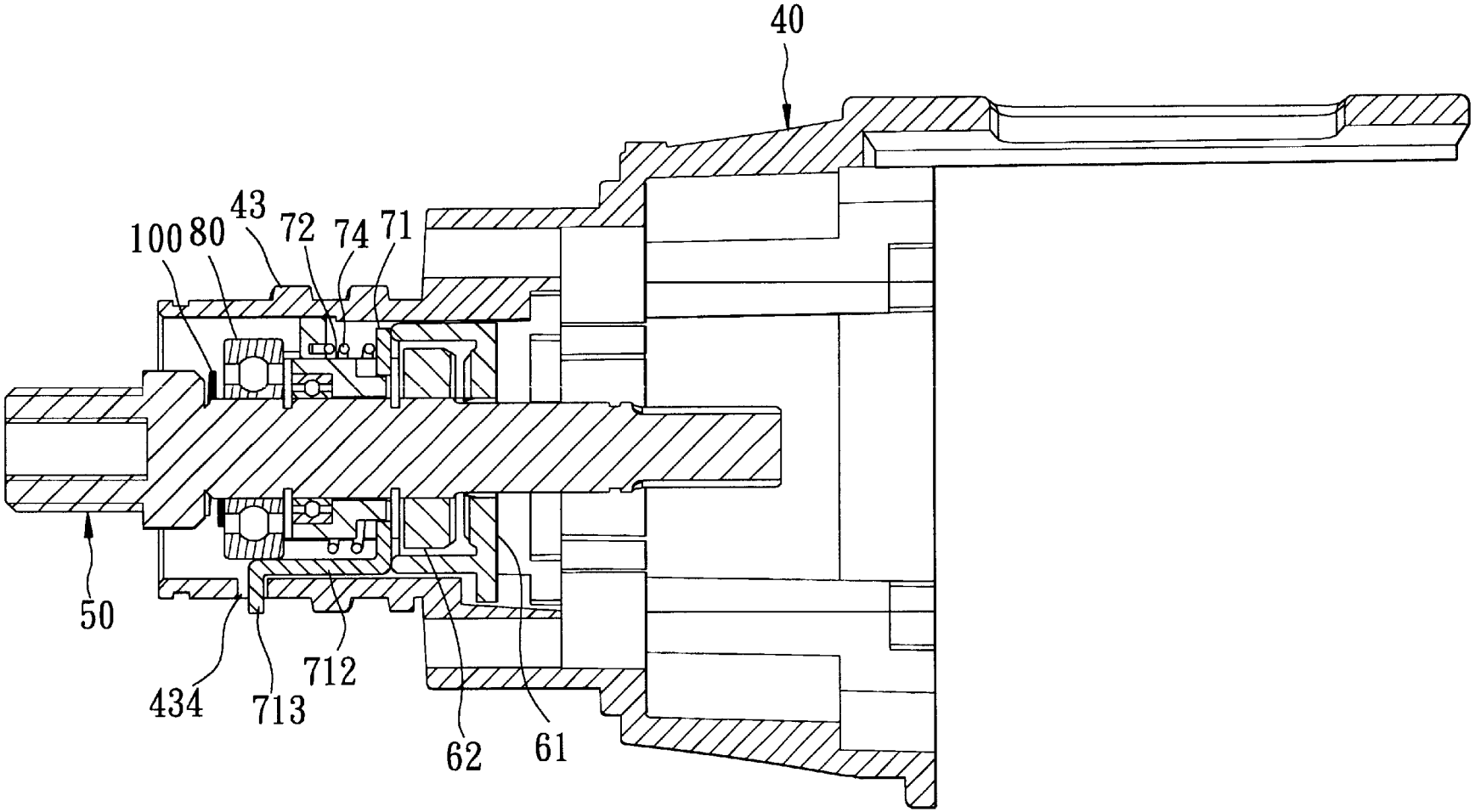
FIG. 9 is a fragmentary sectional view of the second preferred embodiment in the assembled state.

FIGS. 8 and 9 show the second preferred embodiment of a power tool according to the present invention. This embodiment differs from the previous embodiment in that the threaded portion 43 of the housing 40 is formed with a radial slot 434 that extends from the inner surface through to the outer surface of the threaded portion 43 of the housing 40. The engaging end 713 of the operating arm extension 712 of the switching ring 71 is bent to extend through the radial slot 434. A second pushing unit 95 on the inner surface of the operating knob 90 (see FIG. 3) interacts with the engaging end 713 of the operating arm extension 712 of the switching ring 71 in a manner similar to that of the first pushing unit 93 in the previous embodiment.

The power tool of the present invention has the following advantages:

1. Since the fixed ratchet seat 61, the biasing member 100, the rotatable ratchet 62, the latching seat 72, the switching ring 71, the torsion spring 74, the bushing 45, and the first and second bearing members 80, 81 of the power tool of the present invention are all disposed on the sleeve portion 52 of the drive spindle 50 and are all confined in the confining portion 42 of the housing 40, the power tool can be assembled with relative ease.

2. Since the power tool of the present invention employs a bushing 45 and two bearing members 80, 81, smooth and stable operation of the drive spindle 50 can be ensured.

3. Since the operating knob 90 of the power tool of the present invention requires a minimum amount of force for rotating within a small angular displacement so as to switch between the rotary drive and the hammering modes, the power tool is relatively easy to operate.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A power tool comprising:

a motor assembly having an end cap;

a fixed ratchet seat disposed externally of said motor assembly, disposed non-movably and adjacent to said end cap, and formed with first ratchet teeth;

a drive spindle extending rotatably through said fixed ratchet seat and further extending rotatably and slidably through said end cap, said drive spindle being coupled to and driven rotatably by said motor assembly, said drive spindle being axially movable between front and rear limit positions relative to said end cap;

a biasing member for biasing said drive spindle to said front limit position;

a rotatable ratchet mounted on said drive spindle for co-rotation therewith, said rotatable ratchet being formed with second ratchet teeth, wherein said second ratchet teeth disengage said first ratchet teeth when said drive spindle is at the front limit position, and wherein said second ratchet teeth engage said first ratchet teeth when said drive spindle is at the rear limit position;

a latching seat having said drive spindle extending rotatably therethrough, said latching seat being coupled to and moving together with said drive spindle between the front and rear limit positions, said latching seat having one end adjacent to said rotatable ratchet and formed with at least a peripheral latching projection;

a switching ring disposed between said latching seat and said rotatable ratchet, and formed with a through hole for extension of said drive spindle therethrough, said through hole being defined by a periphery that is formed with at least a retaining notch corresponding to said peripheral latching projection on said latching seat;

said switching ring being rotatable relative to said drive spindle from a first angular position, where said peripheral latching projection is misaligned from said corresponding retaining notch and abuts against said periphery of said through hole in said switching ring such that movement of said drive spindle from the front limit position to the rear limit position is prevented, to a second angular position, where said peripheral latching projection is aligned with said corresponding retaining notch so that when said drive spindle is forced toward said end cap of said motor assembly for moving from the front limit position to the rear limit position against the biasing action of said biasing member, said latching projection moves into said corresponding retaining notch;

said switching ring being formed with an operating arm extension parallel to and offset from said drive spindle;

a torsion spring connected between said latching seat and said switching ring for biasing said switching ring from the second angular position to the first angular position;

a generally cylindrical housing mounted on said motor assembly and disposed to surround said drive spindle so as to confine said fixed ratchet seat, said rotatable ratchet, said latching seat and said switching ring therein, said housing permitting said operating arm extension to extend outwardly therefrom; and an operating knob sleeved rotatably on said housing, and having an inner knob surface formed with a pushing unit, said operating knob being rotatable relative to said housing in a first direction to cause said pushing unit to engage said operating arm extension for moving said switching ring from the first angular position to the second angular position against biasing action of said torsion spring, and in an opposite second direction that enables said torsion spring to provide a restoring force for restoring said switching ring from the second angular position back to the first angular position.

2. The power tool as claimed in claim 1, further comprising:

a bushing for mounting rotatably and slidably said drive spindle on said end cap;

a first bearing member having an outer race secured to said housing and an inner race in sliding engagement with said drive spindle; and a second bearing member for mounting rotatably said latching seat on said drive spindle.

3. The power tool as claimed in claim 2, wherein said drive spindle has a bit coupling end distal from said motor assembly, said biasing member having opposite ends abutting respectively against said first bearing member and said bit coupling end of said drive spindle.

* * * * *